US011833111B1

(12) United States Patent
Sammons

(10) Patent No.: US 11,833,111 B1
(45) Date of Patent: Dec. 5, 2023

(54) TEETHING PACIFIER RING

(71) Applicant: Jordan Sammons, Conway, AR (US)

(72) Inventor: Jordan Sammons, Conway, AR (US)

( * ) Notice: Subject to any disclaimer, the term of this patent is extended or adjusted under 35 U.S.C. 154(b) by 0 days.

(21) Appl. No.: 17/841,482

(22) Filed: Jun. 15, 2022

(51) Int. Cl.
*A61J 17/00* (2006.01)
*A61J 17/02* (2006.01)

(52) U.S. Cl.
CPC ..... *A61J 17/1115* (2020.05); *A61J 17/001* (2015.05); *A61J 17/02* (2013.01)

(58) Field of Classification Search
CPC ..... A44C 5/0007; A44C 5/0023; A61J 17/02; A61J 17/001; A61J 17/00; A61J 17/10; A61J 17/105; A61J 17/107; A61J 17/109; A61J 17/111; A61J 17/1111; A61J 17/1115; A61J 17/113; A61J 11/00; A61J 2205/20; A61J 11/0055
See application file for complete search history.

(56) References Cited

U.S. PATENT DOCUMENTS 4,311,149 A * 1/1982 Panicci ..... A61J 17/02 63/3.1
4,972,980 A * 11/1990 Parsons ..... A61J 17/00 24/3.13
2005/0072188 A1* 4/2005 Kirsh ..... A44C 25/00 63/23
2005/0279136 A1* 12/2005 Bowman ..... A44C 15/003 63/21
2007/0067964 A1* 3/2007 McQuarrie ..... A45F 5/02 24/3.13
2009/0025423 A1* 1/2009 Durham ..... A61J 17/02 29/896.4
2010/0030265 A1* 2/2010 Ambrite ..... A44C 5/0007 63/3.1
2010/0082063 A1* 4/2010 Yacktman ..... A61J 17/111 606/234
2011/0057084 A1* 3/2011 Thompson ..... A63H 33/006 248/314
2018/0020744 A1* 1/2018 Davidson ..... A41B 13/10 2/49.1
2018/0200152 A1* 7/2018 Price ..... A61J 17/02
2019/0175454 A1* 6/2019 Pierce ..... A61J 17/1111
2020/0046089 A1* 2/2020 Chinalei ..... A44B 99/00

FOREIGN PATENT DOCUMENTS

DE 19839904 A1 * 3/2000 ..... A63H 3/003
GB 2492118 A * 12/2012 ..... A61J 17/00
WO WO-9409689 A1 * 5/1994 ..... A61J 17/00
WO WO-2009038519 A1 * 3/2009 ..... A61J 17/00

OTHER PUBLICATIONS

Paracord Guild. Mini pacifier paracord bracelet. Aug. 3, 2014. <http://www.paracordguild.com/mini-pacifier-paracord-bracelet/> (Year: 2014).*

* cited by examiner

*Primary Examiner* — Katherine M Shi
(74) *Attorney, Agent, or Firm* — Lyman Moulton, Esq.; Moulton Patents, PLLC

(57) ABSTRACT

The binky rings is the only product of its kind that combines teething beads and pacifiers into one multi-functional product and can be conveniently clipped onto any and all items and surfaces. This unprecedented product is uniquely designed to be large enough to be hard to lose, and small enough to fit in any purse, diaper bag, and even a pocket for transport and quick access. Furthermore, the durable lobster clasps will allow for the option to turn the binky rings into a traditional binky clip, per consumer preference.

15 Claims, 1 Drawing Sheet

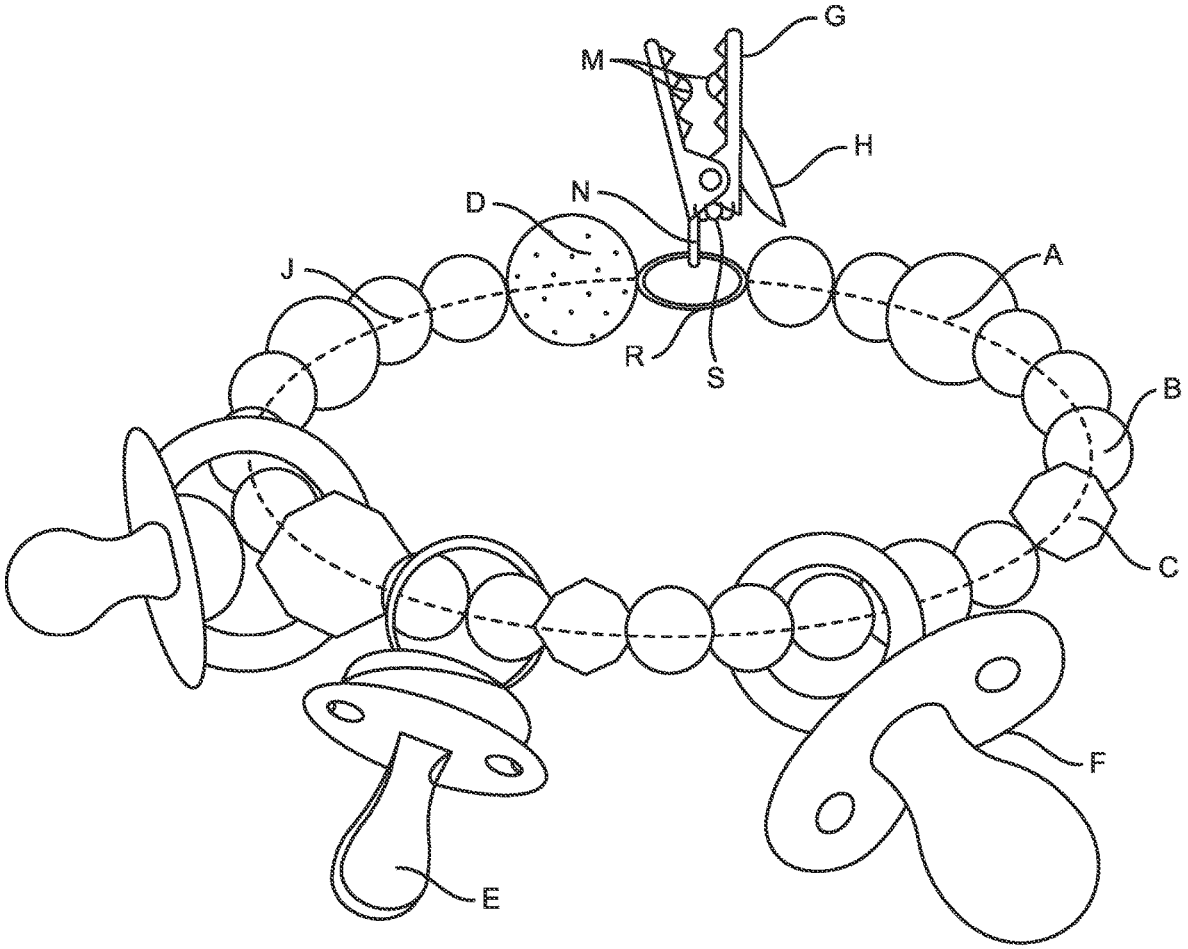
G
M
H
D
N
J
A
R
S
B
C
F
E

TEETHING PACIFIER RING

BACKGROUND

Pacifiers and teething accessories are a go-to for parents/caregivers desiring to soothe an infant; yet, due to size it is very common for them to get lost over time and misplacing them is often prevalent when traveling. This can be incredibly frustrating for parents especially in times where a pacifier or teething accessory is needed, but is nowhere to be found. There have been no products available as original equipment or as an aftermarket to address this problem.

An apparatus that helps soothe infants when teething that is easy to locate and not lose is not being met by any known device or system at present. There have been no products available as original equipment or as an aftermarket to address this problem either.

SUMMARY OF THE INVENTION

The main purpose of the teething pacifier ring is to provide users with a clip-on pacifier ring made of teething beads meant for use when caring for infants.

A teething device disclosed comprising a plurality of teething beads and a string strung through the plurality of teething beads together comprising a teething jewelry. The disclosure also includes a plurality of pacifiers each comprising a nipple, guard and ring interconnected to the teething jewelry via each respective ring. The disclosure further includes a clothing clip comprising two jaws, a hinge and a neck configured to receive the string there through and attach the jewelry to a child's clothing.

Embodiments of the disclosure comprise a thumb boss on one of the two jaws of the clothing clip to enable prying open the clothing clip with one's thumb. The thumb boss on one of the two jaws extends from a jaw side of the hinge to a neck side of the hinge.

BRIEF DESCRIPTION OF THE DRAWINGS

FIG. 1 is a FIG. 1 is a top perspective view of the teething pacifier ring in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a top perspective view of the teething pacifier ring showing first size teething bead referenced as A, a different size teething bead (different shapes, sizes & textures) referenced as B, a different shape teething bead referenced as C, a textured teething bead referenced as D, a first size pacifier referenced as E, a second size pacifier referenced as F, a clothing clip referenced as G, a thumb boss H on the clothing clip G, a string strung through the teething beads J shown in broken lines, a ring R adjoining each end of the string J and attaching a neck N of the clothing clip thereto, a spring S on a neck N side of the hinge and complementary magnets M on inside surfaces of the two jaws in accordance with an embodiment of the present disclosure.

The present disclosed teething pacifier ring, also known as the "Binky Rings" offers a modern accessory that enables users to conveniently carry their pacifiers and teething beads simultaneously and clamp the accessory onto any surface or object, to prevent misplacement. Expanding on the initial design of an average ring, the binky rings introduces a novel ring that is comprised of teething beads to facilitate teething, and holds between three to four pacifiers, depending on the size of the ring. Each end of the ring is strategically designed with a lobster claw clasp that attaches to a plastic pacifier clasp. The binky rings additionally possesses different teething options for babies who do not take pacifiers, but still require teethers as an aide to minimize pain and discomfort, with those options replacing the pacifiers with either three or four small teethers for children. As a result, children will be able to enjoy the variety of pacifiers or teethers, and parents would be able to clip their rings virtually anywhere, which significantly reduces the chances of the medium being misplaced. Not only is this innovative product teaching the child variety, it also helps with sensory development as the binkies can rattle together to make a new noise, have different textures, and come in a wide selection of colors to stimulate their creative minds. The binky rings may benefit all parents who look for effective means to manage the teething stage of their infant.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A teething device comprising:

a plurality of teething beads;

a string strung through the plurality of teething beads and together comprising a teething jewelry;

a plurality of pacifiers each comprising a nipple, guard and ring interconnected to the teething jewelry via each respective ring, wherein the plurality of pacifiers comprises pacifiers of varying nipple, guard and ring sizes; and a clothing clip comprising two jaws, a hinge and a neck configured to receive the string there through and attach the jewelry to a child's clothing.

2. The teething device of claim 1, wherein the plurality of teething beads comprises a spherical teething bead.

3. The teething device of claim 1, wherein the plurality of teething beads comprises a plurality of different sizes.

4. The teething device of claim 1, wherein the plurality of teething beads comprises a plurality of different shapes.

5. The teething device of claim 1, wherein the plurality of teething beads comprises a plurality of different textures.

6. The teething device of claim 1, wherein the two jaws are each serrated on complementary edges.

7. The teething device of claim 1, wherein the two jaws are spring loaded on a neck side of the hinge.

8. The teething device of claim 1, wherein an inside diameter of each of the plurality of the pacifier rings is larger than an outside diameter of any of the plurality of teething beads.

9. The teething device of claim 1, further comprising an interconnect ring configured to receive a beginning of the string and an end of the string.

10. The teething device of claim 1, further comprising an interconnect ring interposed between two of the plurality of teething beads to receive the neck of the clothing clip there through.

11. The teething device of claim 1, further comprising a thumb boss on one of the two jaws of the clothing clip to enable prying open the clothing clip with one's thumb.

12. The teething device of claim 1, further comprising a thumb boss on one of the two jaws and extending from a jaw side of the hinge to a neck side of the hinge.

13. The teething device of claim 1, wherein each of the two jaws each comprise a magnet having complementary polarity with respect to the other.

14. The teething ring of claim 1, wherein the jewelry is strung through each ring of the plurality of pacifiers.

15. The teething device of claim 1, wherein each ring of the plurality of pacifiers receives the jewelry there through.

* * * * *